US005459875A

United States Patent [19]

Fattorusso et al.

[11] Patent Number: 5,459,875

[45] Date of Patent: Oct. 24, 1995

[54] SLIDE FASTENER POUCH STORABLE GARMENT

[76] Inventors: Louis J. Fattorusso, 61 W. 37th St., #2B, New York, N.Y. 10018; Helen Sanchez, 421 Hudson St., Apt. 813, New York, N.Y. 10014

[21] Appl. No.: 338,967

[22] Filed: Nov. 14, 1994

[51] Int. Cl.[6] ..... A41D 7/00; A41C 3/00

[52] U.S. Cl. ..... 2/67; 2/247; 2/250; 450/89

[58] Field of Search ..... 2/67, 247, 250, 2/251, 86, 89, 104; 450/89, 36; 383/4

[56] References Cited

U.S. PATENT DOCUMENTS

| | | | |
|---|---|---|---|
| 2,492,862 | 12/1949 | Harvey | 2/247 |
| 2,562,669 | 7/1951 | Keller | 450/36 |
| 2,624,881 | 1/1953 | Lee | 2/247 |
| 2,661,470 | 12/1953 | Day | 2/67 X |
| 2,666,919 | 1/1954 | Spangard | 450/36 |
| 3,109,431 | 11/1963 | Jefferson | 450/36 X |
| 3,398,749 | 8/1968 | Barg | 450/89 |
| 3,425,420 | 2/1969 | Steinberger | 450/36 |
| 4,011,898 | 3/1977 | Hubbard | 383/4 |
| 4,214,383 | 7/1980 | Allen | 36/1 |
| 4,404,689 | 9/1983 | DeWan | 2/247 |
| 4,993,844 | 2/1991 | Robinson et al. | 383/38 |
| 5,002,183 | 3/1991 | Okano | 206/287 |
| 5,020,673 | 6/1991 | Adams | 206/581 |
| 5,067,178 | 11/1991 | Katchka | 2/247 |
| 5,116,301 | 5/1992 | Robinson et al. | 493/215 |

*Primary Examiner*—Clifford D. Crowder
*Assistant Examiner*—Shirra L. Jenkins
*Attorney, Agent, or Firm*—Richard L. Miller

[57] ABSTRACT

A garment, having a garment body, having a pair of brassiere cups located adjacent to one another. A slide fastener having a pair of tracks and a slide is attached to the cups, with the tracks attached along the periphery of the cups and the slide originating between the cups. Upon operation of the slide, the tracks are brought together, in turn bringing the cups together forming a pouch with a cavity therebetween, whereby, the garment body can be stuffed into the pouch, so as to be stored an contained therein.

8 Claims, 1 Drawing Sheet

FIG. 1
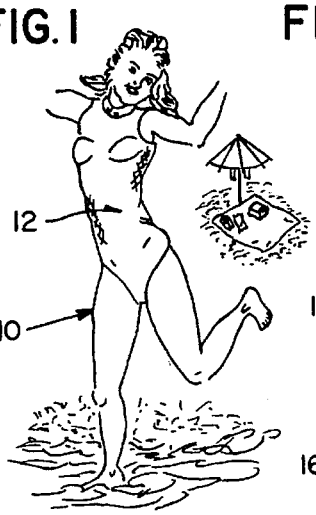
FIG. 2
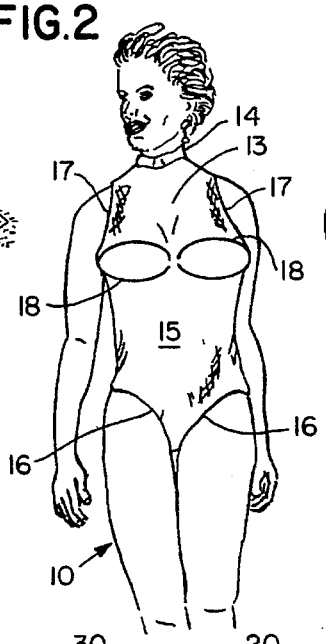
FIG. 9
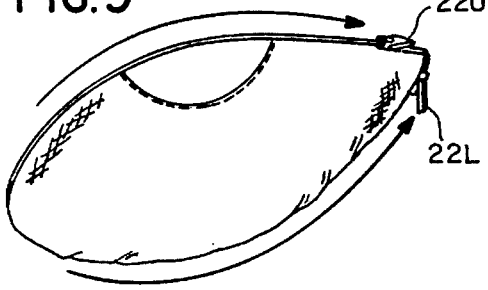
FIG. 7
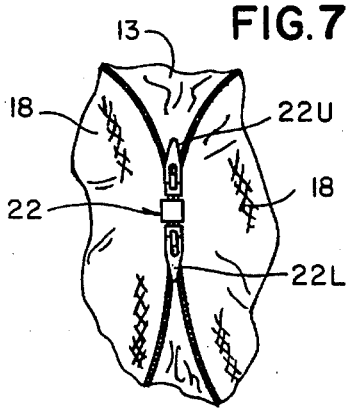
FIG. 5
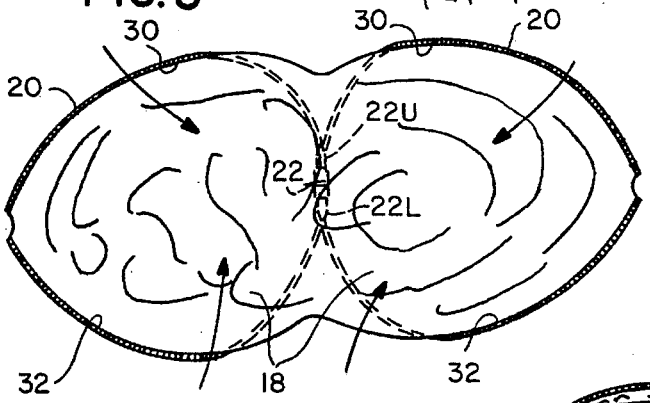
FIG. 8A
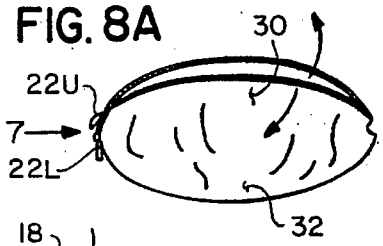
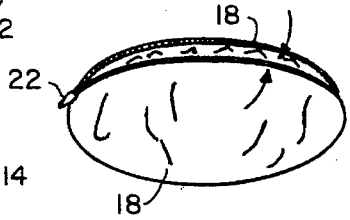
FIG. 8B
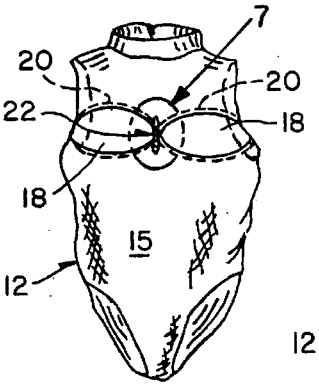
FIG. 3
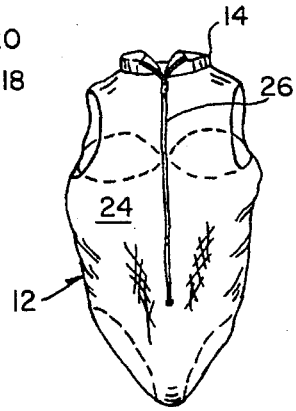
FIG. 4
FIG. 6
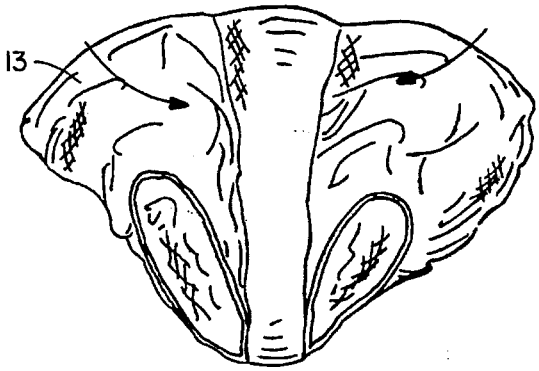

SLIDE FASTENER POUCH STORABLE GARMENT

BACKGROUND OF THE INVENTION

The invention relates to a slide fastener pouch storable garment. More particularly, the invention relates to a garment having a slide fastener, that folds into an integral pouch upon operation of the slide fastener.

Conventional garments, such as bathing suits and body suits, do not fold neatly. The end result is that they are stuffed into a suitcase, tote bag, or drawer.

U.S. Pat. No. 4,993,844 to Robinson et al., discloses a compartmented double zipper pouch.

U.S. Pat. No. 5,116,301 to Robinson et al., discloses a method of making a double zipper pouch.

U.S. Pat. No. 5,002,183 to Okano, discloses a garment bag.

U.S. Pat. No. 5,020,673 to Adams, discloses a carrying case for personal items, having a plurality of zippered pockets.

While these units may be suitable for the particular purpose employed, or for general use, they would not be as suitable for the purposes of the present invention as disclosed hereafter.

SUMMARY OF THE INVENTION

It is an object of the invention to provide a garment that may be worn as a body suit or as bathing suit.

It is another object of the invention to provide a garment that contains slide fasteners, and collapses into a storage pouch upon operation of the slide fasteners.

It is a further object of the invention, that the storage pouch is comprised of brassiere cups from the garment.

The invention is a garment, having a garment body, having a pair of brassiere cups located adjacent to one another. A slide fastener having a pair of tracks and a slide is attached to the cups, with the tracks attached along the periphery of the cups and the slide originating between the cups. Upon operation of the slide, the tracks are brought together, in turn bringing the cups together forming a pouch with a cavity therebetween. The garment body in stuffed into the pouch.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like reference numerals depict like elements throughout the several views. The drawings are briefly described below.

FIG. 1 is a diagrammatic perspective view illustrating a woman wearing a bathing suit embodiment of the instant invention.

FIG. 2 is a diagrammatic perspective view illustrating a woman wearing a body suit embodiment of the instant invention.

FIG. 3 is a diagrammatic perspective front elevational view of a typical garment according to the present invention.

FIG. 4 is a diagrammatic perspective rear elevational view thereof.

FIG. 5 is a diagrammatic perspective view of the material being folded and compressed into the pouch formed from the brassiere cups.

FIG. 6 is a view similar to FIG. 5 but with the garment further folded.

FIG. 7 is a diagrammatic perspective view of the instant invention per se, with parts broken away, taken in the direction of arrow 7 in FIG. 8A, and also from inside the garment in the area of the dotted circle indicated by arrow 7 in FIG. 3.

FIG. 8A is a diagrammatic perspective view of a dual slide embodiment of the instant invention per se, with the garment being compressed and the slide fasteners on the pouch about to be closed.

FIG. 8B is a diagrammatic perspective view of a single slide embodiment of the instant invention per se, with the garment being compressed and the slide fastener on the pouch about to be closed.

FIG. 9 is a diagrammatic perspective view of an embodiment of the instant invention per se, wrinkled, folded, and self-contained in an integral pouch.

DETAILED DESCRIPTION OF THE PREFERRED EMBODIMENTS

FIG. 1 illustrates a woman 10 wearing a garment 12. The garment may be made of a water-resistant fabric, typically spandex and nylon.

Referring to FIG. 2, the garment 12 has a garment body 13, which forms a continuous opaque covering of the woman 10, and has a neck opening 14, a front 15, and a pair of leg openings 16. The garment 12 also has brassiere cups 18 on the front 15. The cups 18 are adjacent to one another FIG. 3 illustrates just the garment 12 per se. Each cup 18 has a track 20. The track 20 on one cup is complementary with the track 20 on the other cup. A slides 22U and 22L, originates in between the cups 18, and travels along the tracks 20, bringing the two tracks together and intermeshing them, thus bringing the cups 18 together. Thus, the slides 22U and 22L and both tracks 20 form a slide fastener device. The slide fastener device is attached entirely behind the front 15 of the garment.

FIG. 4 is a view of the garment 12, illustrating a back 24. A vertical closure 26, which may also comprise an additional slide fastener device which, extends down the back 26 from the neck opening 14, and allows the garment 12 to be easily donned and removed.

FIG. 5 details the cups 18 with the remainder of the garment broken away. The cups 18 are illustrated in an open position, in which the cups 18 are in substantially the same plane. As illustrated, each track 20 is sewn behind the cup, in a circular path around the periphery of the cup 18. The slides 22 joins the tracks 20 of both cups 18 together as it is operated. As the tracks 20 are brought together, the cups 18 become a storage pouch, forming a cavity therein. The garment is pushed into the cavity in the direction of the arrows as the slide 22 is operated to bring the cups into a closed position, where the cups form a pouch that encloses the garment body 13.

As illustrated in FIG. 5, the cups 18 have an upper periphery 30 and a lower periphery 32. The garment 12 in this emboidment has two slide fastener devices. In this case, a complementary pair of first tracks 20 are attached along the upper periphery 30, and a complementary pair of second tracks 20 are attached along the lower periphery 32. An upper slide 22U and a lower slide 22L originate from in between the cups 18. When operated, an upper slide 22U joins the tracks 20 along the upper periphery 30, and a lower slide 22L joins the tracks 20 along the lower periphery 32.

FIG. 6 illustrates the garment body 13 being stuffed into the pouch in the direction indicated by the arrows.

FIG. 7 illustrates a dual slide fastener embodiment of the garment body 13 partially stuffed into the pouch, with the upper slide 22U and lower slide 22L about to be operated to bring the cups 18 together to seal the pouch.

FIG. 8A illustrates a dual slide fastener embodiment of the garment body 13 almost completely stuffed into the pouch created by the cups 18, the pouch ready to be sealed by operating the slide 22U to join the tracks 20.

FIG. 8B illustrates a single slide fastener embodiment of the garment body 13 almost completely stuffed into the pouch created by the cups 18, the pouch ready to be sealed by operating the slide 22 to join the tracks 20.

FIG. 9 illustrates a dual slide fastener embodiment of the pouch fully sealed, where the upper slide 22U and lower slide 22L have been fulled operated in the directions indicated by the arrows.

It is important to note that the brassiere cups 18 may refer to any pair of adjacent circular sections on a garment. Therefore, the garment can be converted into its own integral storage pouch by operating the slide(s) fastener which brings these circular sections together to form the pouch.

What is claimed is:

1. A garment, for selectively covering a woman and storing in an integral pouch, comprising:

a) a garment body made of fabric, having a front, having leg openings, and having a pair of brassiere cups adjacent to one another and in substantially the same plane when in an open position; and b) a slide fastener, comprising a pair of tracks and a slide, one of said tracks being attached around the periphery of one of the said cups and the other of said tracks being attached around the periphery of the other of said cups, the slide operable to bring the tracks together, bringing the cups together into a closed position, to form a pouch with a cavity therein.

2. The garment as described in claim 1, wherein the slide fastener is attached entirely behind the front of the garment.

3. The garment as described in claim 2, wherein the cups have an upper periphery and a lower periphery, and having two slide fasteners: one slide fastener having a pair of complementary first tracks attached along the upper periphery of the cups and the other having a pair of complementary second tracks attached along the lower periphery of the cups, the slide fasteners further having an upper slide joining the complementary first tracks attached along the upper periphery, and a lower slide joining the complementary second tracks attached along the lower periphery.

4. The garment as described in claim 3, wherein each of the slides originates between the cups.

5. The garment as described in claim 2, wherein the slide originates between the cups.

6. The garment as described in claim 5, wherein the garment body has a back, the back further comprising a vertical closure, for allowing the garment to be easily donned and removed.

7. A method of storing a garment in an integral storage pouch, the garment having a garment body and a pair of brassiere cups, a slide fastener comprising a track attached behind the periphery of each cup and a slide for joining the tracks, comprising the steps of:

a) operating the slide fastener to join the tracks and bring the cups together, forming a pouch therebetween; and b) stuffing the garment body into the pouch.

8. The method as recited in claim 7, wherein the cups have an upper periphery and a lower periphery, and the garment has two slide fastener devices: one slide fastener device having a pair of tracks attached along the upper periphery and the other slide fastener device having a pair of tracks attached along the lower periphery, and the step of operating the slide fastener further comprises:

operating both slide fasteners devices to join the pairs of tracks attached to the upper periphery of the cups, and to join the tracks attached to the lower periphery of the cups.

* * * * *